United States Patent [19]

Deutsch

[11] Patent Number: 4,502,360

[45] Date of Patent: Mar. 5, 1985

[54] HARMONIC SELECTION COUPLING IN AN ELECTRONIC MUSICAL INSTRUMENT

[75] Inventor: Ralph Deutsch, Sherman Oaks, Calif.

[73] Assignee: Kawai Musical Instruments Mfg. Co., Ltd., Hamamatsu, Japan

[21] Appl. No.: 486,473

[22] Filed: Apr. 19, 1983

[51] Int. Cl.[3] ..... G10H 1/00; G10H 7/00

[52] U.S. Cl. ..... 84/1.23; 84/1.24; 84/DIG. 4

[58] Field of Search ..... 84/1.01, 1.03, 1.17, 84/1.19–1.27, DIG. 4, DIG. 22

[56] References Cited

U.S. PATENT DOCUMENTS 4,085,644 4/1978 Deutsch et al. ..... 84/1.01

4,342,248 8/1982 Deutsch et al. ..... 84/DIG. 4

*Primary Examiner*—Stanley J. Witkowski

*Attorney, Agent, or Firm*—Ralph Deutsch

[57] ABSTRACT

An electronic musical instrument of the type which synthesizes a musical waveshape from a preselected set of harmonic coefficients is disclosed in which the tonal effects of a set of intramanual couplers is produced. The desired tonal effect is obtained by selecting particular subsets of the harmonic coefficients and combining the selected subsets in response to actuated tone switches.

11 Claims, 5 Drawing Figures

HARMONIC SELECTION COUPLING IN AN ELECTRONIC MUSICAL INSTRUMENT

BACKGROUND OF THE INVENTION

1. Field of the Invention

This invention relates to electronic musical tone synthesis and in particular is concerned with the selection of harmonics to imitate intramanual coupling.

2. Description of the Prior Art

Intramanual couplers are commonly used in the implementation of both theatre and concert type organs. Intramanual couplers are used to cause a selected combination of notes to sound for each actuated keyboard switch. Concert organs usually have intramanual couplers designed as octave couplers such as a 16-foot or a 4-foot coupler. If the 4-foot coupler is actuated, for example, then each note played on the keyboard will simultaneously cause the same tone to be played one octave higher than the actuated note. The use of intramanual couplers permit the musician to produce a large ensemble of notes while actually keying a relatively small number of keyswitches.

Intramanual couplers were skillfully employed in the design of theatre organs to produce a very large number of stops from a comparatively few ranks of pipes. In this design, which is called unification, the intramanual coupling is selectively implemented for an individual rank of pipes rather than for the entire keyboard as is the case for a concert organ. For example, the set of intramanual couplers for a tibia rank of pipes are frequently implemented to provide stops at 8′, 4′, $2\frac{2}{3}$′, 1 3/5′ and 1′ pitch.

Intramanual couplers can, at least theoretically, be easily implemented in a digital musical tone generator or in an analog musical tone generator. An example of an electronic intramanual coupling arrangement is described in U.S. Pat. No. 3,697,661 entitled "Multiplexed Pitch Generator System For Use In A Keyboard Musical Instrument." In the disclosed system, the keyboard switches are scanned by means of a time division multiplexing arrangement. The intramanual coupling is implemented by delaying a pulse associated with an actuated keyswitch and reinserting the pulse at a later time slot corresponding to the desired intramanual coupling spacing.

A practical problem arises when one implements intramanual coupling in most types of digital tone generators. Each actuated intramanual coupler requires an additional set of tone generators that can be assigned to the keyboard having the intramanual couplers. The digital tone generators are a relatively expensive subsystem of a digital musical tone generator and it is costly to increase the number of these generators. Herein is an apparent paradox. Intramanual couplers were originally used to inexpensively expand the tonal resources of an organ. While analog organs can exploit this economical tone expansion scheme of intramanual couplers, the use of intramanual couplers for a digital musical tone generator may be a luxury subsystem.

A system design intended to imitate the tonal response of an intramanual coupler for a unified organ design has been employed in the implementation of digital musical tone generators. The underlying scheme is one that is called harmonic suppression. In this scheme a 4-foot stop is obtained by using a waveshape in which all the odd-numbered harmonic components are eliminated. A $2\frac{2}{3}$-foot stop is obtained by using a waveshape corresponding to the third harmonic sequence of the 3,6,9,12,15, . . . , harmonics. A 2-foot stop is obtained by using a waveshape corresponding to the fourth harmonic sequence of the 4,8,12,16, . . . , harmonics.

In U.S. Pat. No. 4,085,644 entitled "Polyphonic Tone Synthesizer" a system is described whereby the tonal effect of unified stops is obtained by storing sets of harmonic coefficients having the appropriate missing harmonic coefficients.

In U.S. Pat. No. 4,286,491 entitled "Unified Tone Generation In A Polyphonic Tone Synthesizer" a system is described for creating the tonal effect of unified stops by the combination of three master data sets each of which corresponds to a period of the generated musical tone. The three master data sets are computed separately from stored sets of even and odd harmonic coefficient values. The master data set values are combined using their symmetric properties and are transferred sequentially to a digital-to-analog converter in repetitive cycles at a rate proportional to the unison pitch of the corresponding keyboard note to produce the tone color of a combination of unified tones.

Harmonic suppression does not provide the identical tonal effect of intramanual coupling for a mutation coupler such as a $2\frac{2}{3}$-foot or 1 3/5-foot coupler. Harmonic suppression provides an exact third or fifth harmonic base tone while intramanual mutation couplers are implemented to actuate the nearest musical note to the true third or fifth harmonic base note. Thus harmonic suppression schemes provide an approximation to the tonal effects produced by mutation intramanual couplers.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created using a set of harmonic coefficients which are selected by actuated tone switches and which are selectively augmented in response to the actuation of a set of unification stop switches. At the end of each computation cycle, the computed master data set is stored in a main register.

Following each individual computation cycle, a transfer cycle is initiated during which the stored master data set is transferred to a note register which is an element of each of a number of tone generators. The tone generators are assigned to actuated keyboard switches. The data stored in a note register is repetitively and sequentially read out to a digital-to-analog converter at a rate corresponding to the fundamental frequency associated with its assigned actuated keyboard switch. The output tone generation continues uninterrupted during the computation and transfer cycles.

An object of the present invention is to provide the tonal effects of intramanual couplings without increasing the number of tone generators assigned to a keyboard.

Another object of the present invention is to provide the tonal effects of intramanual couplers for any preselected set of harmonic coefficients, or a combination of preselected harmonic coefficients, without increasing the memory size of the stored harmonic coefficients.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic tone generator in which harmonic coefficients are selectively added to produce the tonal effect of intramanual coupling. The tone generator is incorporated into a musical tone generator of the type which synthesizes musical waveshapes by implementing a discrete Fourier transform algorithm. A tone generation system of this variety is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer or correspond to combinations of several elements appearing in the referenced patent.

Figure 1:
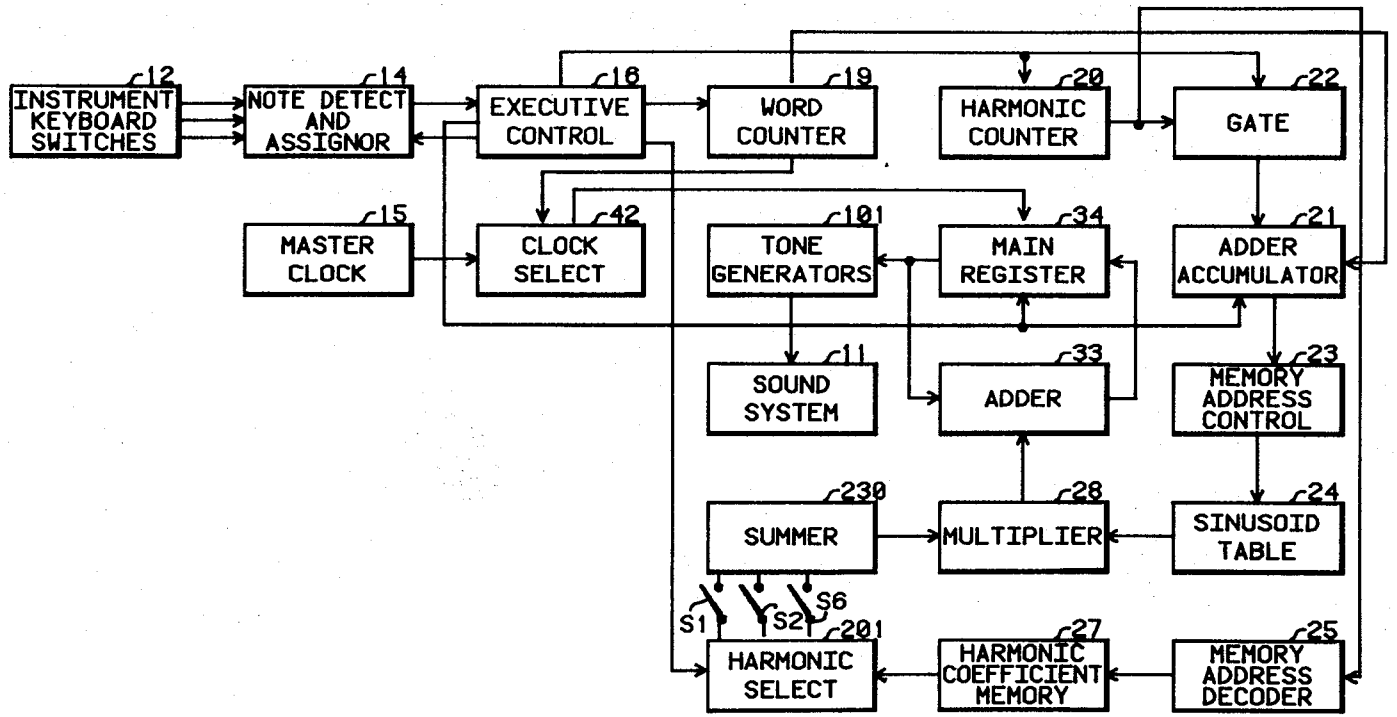
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of instrument keyboard switches 12. If one or more of the keyboard switches has a switch status change and is actuated ("on" position), the note detect and assignor 14 encodes the detected keyboard switch having the status change to an actuated state and stores the corresponding encoded note information for the actuated keyswitches. One member of a set of tone generators, contained in the system block labeled tone generators 101, is assigned to each actuated keyswitch.

A suitable note detect and assignor subsystem is described in U.S. Pat. No. 4,022,098 which is hereby incorporated by reference.

When one or more keyswitches have been actuated, the executive control 16 initiates a repetitive sequence of computation cycles. During each computation cycle, a master data set consisting of 64 data words, or points, is computed in a manner described below and stored in the main register 34. The 64 data words are generated using a combination harmonic sequence comprising 32 harmonic coefficients which is provided at the output of the summer 230.

The 64 data words in the master data set correspond to the amplitudes of 64 equally spaced points of one cycle of the audio waveform for the musical tone produced by a corresponding one of the tone generators 101. The general rule is that the maximum number of harmonics in the audio tone spectra is no more than one-half of the number of data points in one complete waveshape period. Therefore, a master data set comprising 64 data words corresponds to a maximum of 32 harmonics.

At the completion of each computation cycle in the repetitive sequence of computation cycles, a transfer cycle is initiated during which the master data set residing in the main register 34 is transferred to each note register corresponding to the tone generators in the tone generators 101 which have been assigned to an actuated keyswitch. Each tone generator has an associated note register.

The master data set stored in a note register is read out sequentially and repetitively and transferred to a digital-to-analog converter at a rate determined by a note clock associated with the note register. The note clock timing signals correspond to the fundamental frequency of the musical note associated with the actuated switch to which the corresponding tone generator has been assigned by the note detect and assignor 14.

The note clocks can be implemented in any one of a wide variety of implementing adjustable frequency timing clocks. Advantageously the note clocks may be implemented as voltage controlled oscillators. One such implementation in the form of voltage controlled oscillators is described in detail in U.S. Pat. No. 4,067,254 which is hereby incorporated by reference.

A digital-to-analog converter is contained in the system block labeled sound system 11. The musical waveshape produced by the digital-to-analog converter is transformed into an audible sound by means of a sound system consisting of a conventional amplifier and speaker subsystem which are also contained in the system block labeled sound system 11.

As described in the referenced U.S. Pat. No. 4,085,644 it is desirable to be able to continuously recompute and store the generated master data sets during a repetitive sequence of computation cycles and to load this data into the associated note registers while the actuated keys remain actuated, or depressed, on the keyboards.

In the manner described in the referenced U.S. Pat. No. 4,085,644, the harmonic counter 20 is initialized to its minimal, or zero, count state at the start of each computation cycle. Each time that the word counter 19 is incremented so that it returns to its initial, or minimal count state because of its modulo counting implementation, a signal is provided which increments the count state of the harmonic counter 20. The word counter 19 is implemented to count modulo 64 which is the number of data words in the master data set which is generated and stored in the main register 34. The harmonic counter 20 is implemented to count modulo 32. This number corresponds to the maximum number of harmonics consistent with a master data set comprising 64 words.

At the start of each computation cycle, the accumulator in the adder-accumulator 21 is initialized to a zero value. Each time that the word counter 19 is incremented, the adder-accumulator adds the current count state of the harmonic counter 20 to the sum contained in the accumulator. This addition is implemented to be modulo 64.

The content of the accumulator in the adder-accumulator 21 is used by the memory address decoder 23 to access trigonometric sinusoid values from the sinusoid table 24. The sinusoid table 24 is advantageously implemented as a read only memory storing values of the trigonometric function sin $(2\pi\phi/64)$ for $0 \leqq \phi \leqq 64$ at intervals of D. D is a table resolution constant.

The multiplier 28 multiplies the trigonometric value read out of the sinusoid table by a harmonic coefficient provided by the summer 230. The product value formed by the multiplier 28 is furnished as one input to the adder 33.

The contents of the main register 34 are initialized to a zero value at the start of a computation cycle. Each time that the word counter 19 is incremented, the content of the main register 34 at an address corresponding to the count state of the word counter is read out and furnished as an input to the adder. The sum of the inputs to the adder 33 are stored in the main register 34 at a memory location equal, or corresponding, to the count state of the word counter 19. After the word counter 19 has been cycled for 32 complete cycles of 64 counts, the main register 34 will contain the master data set.

Figure 2:
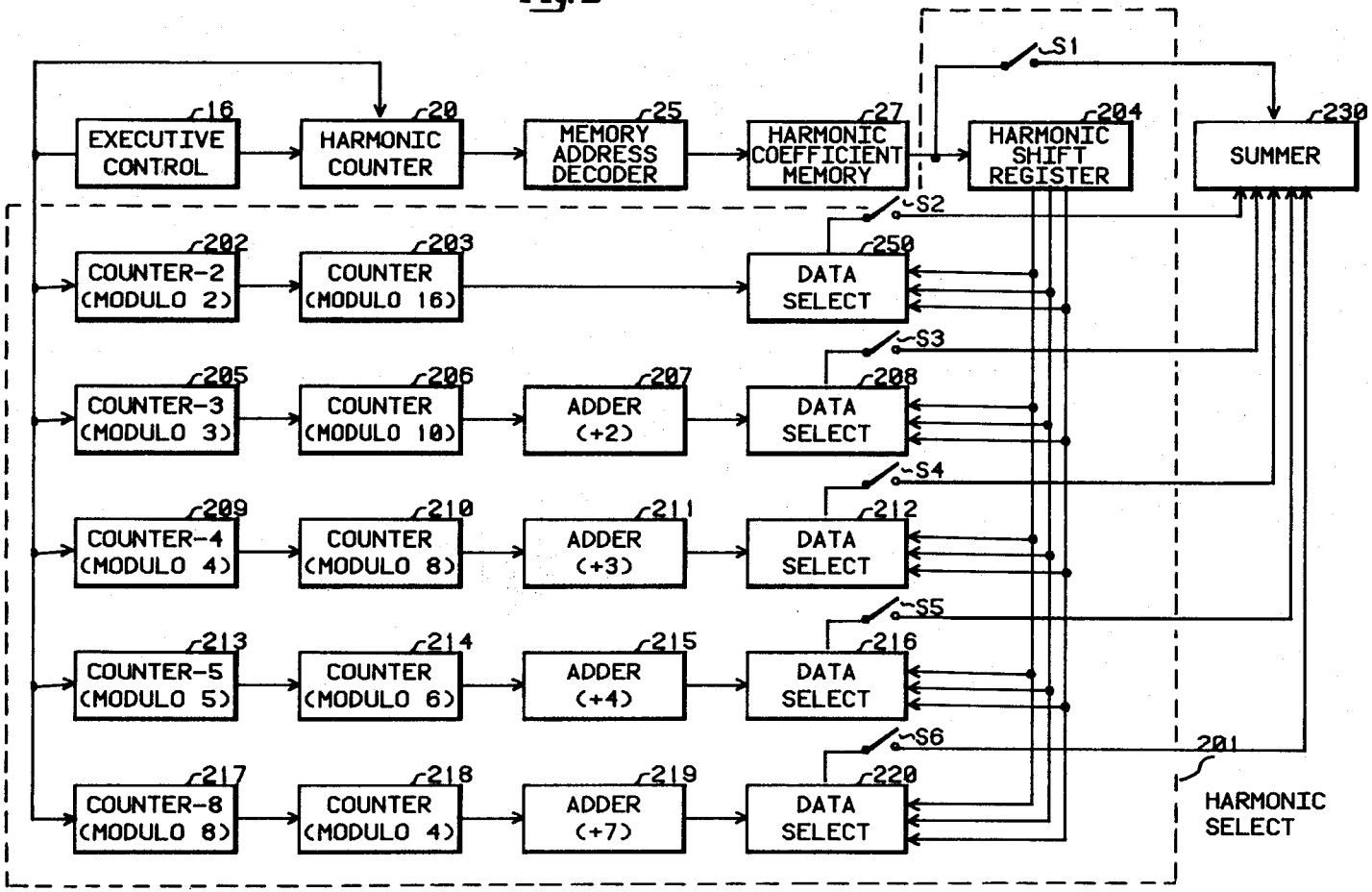
FIG 2 is a schematic diagram of the harmonic select 201.

FIG. 2 is a schematic block diagram of the harmonic select 201. The memory address decoder 25 reads out harmonic coefficients from the harmonic coefficient memory 27 in response to the count state of the harmonic counter 20. The accessed harmonic coefficients from the harmonic coefficient memory 27 are stored in the harmonic shift register 204.

The harmonic shift register 204 is implemented as a serial-input device with parallel output terminals. The parallel output data from the harmonic shift register 204 is provided to the set of data select devices 250, 208,212, 216, and 220.

Counter-2 202 is implemented to count modulo 2. This modulo number is called a preselected counting number. Counter 203 is implemented to count modulo 16. Each time that the counter-2 220 is incremented so that it returns to its initial, or minimal, count state a reset signal is generated. This generated reset signal is used to increment the count state of the counter 203.

The count states of the counter 203 are decoded onto separate select lines by a binary count state decoder which is an element of the data select 250. The decoded count state data appearing on the select lines are used to select the corresponding output data provided to the data select 250 by the harmonic shift register 204. The net result is that the output data from the data select 250 consists of the harmonic coefficient sequence corresponding to the harmonic sequence 1,2,3,4, . . . ,16. The output harmonic coefficients from the data select 250 occur at a time sequence corresponding to the 2,4,6, . . . ,32 count states of the harmonic counter 20. In this fashion the harmonic coefficient sequence provided from the output of the data select 250 corresponds to the harmonic coefficients for a 4-foot stop having the same first 16 harmonic coefficient values as the tone determined by the harmonic coefficients read out from the harmonic coefficient memory 27. The harmonic coefficient sequence provided at the output of the data select 250 are furnished to the summer 230 if the switch S2 is actuated ("closed" or "on" position).

Counter-3 205 is implemented to count modulo a value of three for the preselected counting number. Counter 206 is implemented to count modulo 10. Each time that counter-3 205 is incremented so that it returns in its initial, or minimal, count state a reset signal is generated. This generated reset signal is used to increment the count state of the counter 206.

Adder 207 adds a constant value corresponding to the binary value of decimal 2 to the count state of the counter 206. This added constant value is a preselected offset number. The binary output data from the adder 207 are decoded onto separated select lines by a binary state decoder which is an element of the data selected 208. The decoded count state data appearing on the select lines are used to select the corresponding output data provided to the data select 208 by the harmonic shift register 204. The net result is that the output data from the data select 208 consists of the harmonic coefficient sequence corresponding to the harmonic sequence 1,2,3, . . . ,10. The output harmonic coefficient sequence from the data select 208 occurs at a time sequence corresponding to the 3,6,9, . . . ,30 count states of the harmonic counter 20. In this fashion the output of the data select 208 corresponds to the harmonic coefficients for a $2\frac{2}{3}$-foot stop having the same first valued 10 harmonic coefficients as the tone determined by the harmonic coefficients read out from the harmonic coefficient memory 27. The harmonic coefficient sequence provided at the output of the data select 208 is furnished to the summer 230 if the switch S3 is actuated.

In a fashion analogous to that described for the $2\frac{2}{3}$-foot harmonic coefficient selection, the combination of the counter-4 209, counter 210, adder 211 and the data select 212 provides a harmonic coefficient sequence corresponding to a 2-foot stop.

In a fashion analogous to that described for the $2\frac{2}{3}$-foot harmonic selection, the combination of the counter-5 213, counter 214, adder 215 and the data select 216 provides a harmonic coefficient sequence corresponding to a 1 3/5-foot stop.

The output harmonic coefficient sequences passed by the the actuation of their corresponding tone switches S1 through S6 are combined by means of the summer 230 to form a combination harmonic coefficient sequence.

In a fashion analogous to that described for the $2\frac{2}{3}$-foot harmonic coefficient selection, the combination of the counter-8 217, counter 218, adder 219 and the data select 220 provides a harmonic coefficient sequence corresponding to a 1-foot stop.

Table 1 lists the harmonic sequence for the harmonic coefficients that are stored in the harmonic shift register for the 32 count states of the harmonic counter 20. The remainder of the count states 17 to 32 have been omitted from Table 1 since it is obvious how the omitted entries are written.

TABLE 1

| | Harmonics for coefficients stored in shift register | | | | | | | | | | | | | | | |
|---|---|---|---|---|---|---|---|---|---|---|---|---|---|---|---|---|
| Output tap | 1 | 2 | 3 | 4 | 5 | 6 | 7 | 8 | 9 | 10 | 11 | 12 | 13 | 14 | 15 | 16 |
| 1 | 1 | 0 | 0 | 0 | 0 | 0 | 0 | 0 | 0 | 0 | 0 | 0 | 0 | 0 | 0 | 0 |
| 2 | 2 | 1 | 0 | 0 | 0 | 0 | 0 | 0 | 0 | 0 | 0 | 0 | 0 | 0 | 0 | 0 |
| 3 | 3 | 2 | 1 | 0 | 0 | 0 | 0 | 0 | 0 | 0 | 0 | 0 | 0 | 0 | 0 | 0 |
| 4 | 4 | 3 | 2 | 1 | 0 | 0 | 0 | 0 | 0 | 0 | 0 | 0 | 0 | 0 | 0 | 0 |
| 5 | 5 | 4 | 3 | 2 | 1 | 0 | 0 | 0 | 0 | 0 | 0 | 0 | 0 | 0 | 0 | 0 |
| 6 | 6 | 5 | 4 | 3 | 2 | 1 | 0 | 0 | 0 | 0 | 0 | 0 | 0 | 0 | 0 | 0 |
| 7 | 7 | 6 | 5 | 4 | 3 | 2 | 1 | 0 | 0 | 0 | 0 | 0 | 0 | 0 | 0 | 0 |

TABLE 1-continued

| Output tap | Harmonics for coefficients stored in shift register | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| 8 | 8 | 7 | 6 | 5 | 4 | 3 | 2 | 1 | 0 | 0 | 0 | 0 | 0 | 0 | 0 | 0 |
| 9 | 9 | 8 | 7 | 6 | 5 | 4 | 3 | 2 | 1 | 0 | 0 | 0 | 0 | 0 | 0 | 0 |
| 10 | 10 | 9 | 8 | 7 | 6 | 5 | 4 | 3 | 2 | 1 | 0 | 0 | 0 | 0 | 0 | 0 |
| 11 | 11 | 10 | 9 | 8 | 7 | 6 | 5 | 4 | 3 | 2 | 1 | 0 | 0 | 0 | 0 | 0 |
| 12 | 12 | 11 | 10 | 9 | 8 | 7 | 6 | 5 | 4 | 3 | 2 | 1 | 0 | 0 | 0 | 0 |
| 13 | 13 | 12 | 11 | 10 | 9 | 8 | 7 | 6 | 5 | 4 | 3 | 2 | 1 | 0 | 0 | 0 |
| 14 | 14 | 13 | 12 | 11 | 10 | 9 | 8 | 7 | 6 | 5 | 4 | 3 | 2 | 1 | 0 | 0 |
| 15 | 15 | 14 | 13 | 12 | 11 | 10 | 9 | 8 | 7 | 6 | 5 | 4 | 3 | 2 | 1 | 0 |
| 16 | 16 | 15 | 14 | 13 | 12 | 11 | 10 | 9 | 8 | 7 | 6 | 5 | 4 | 3 | 2 | 1 |

Figure 3:
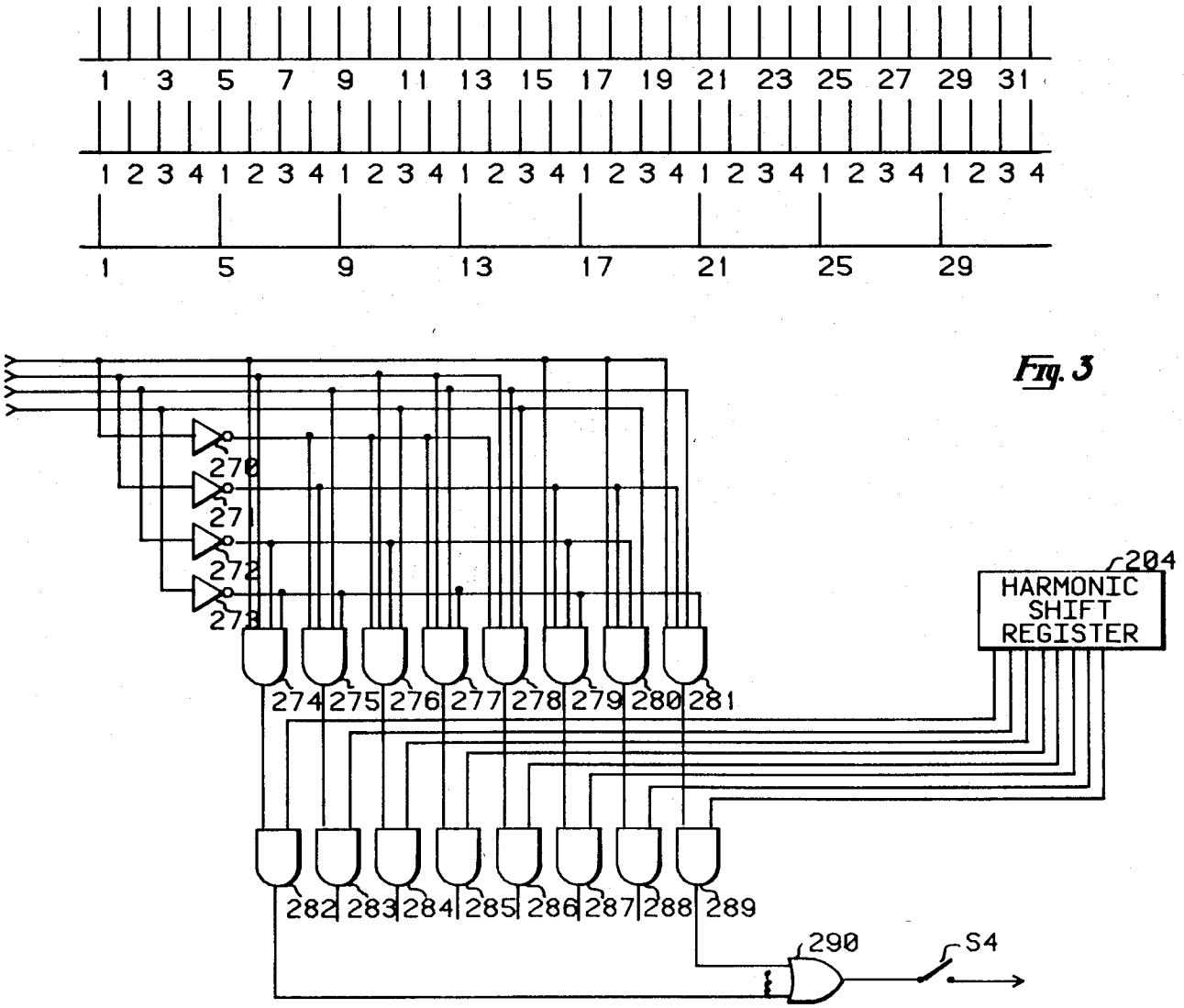
FIG. 3 is a schematic diagram of the data select 212.

FIG. 3 shows the logic for implementing the data select 212. The top timing diagram illustrates the timing pulses used to increment the harmonic counter 20. The middle timing diagram shows the count states of the counter-4 209. The bottom timing diagram illustrates the timing of the data furnished by the adder 211. The numbers correspond to the decimal equivalent of the count state of the counter-4 209 incremented by 3+1. The one increment is used for the decimal equivalence of equating the initial "0" binary state of the counter-4 209 to the decimal value of "one."

The output of the adder 211 comprises four parallel data lines. The binary states of these four data lines are decoded into the input signals to the set of AND-gates 274 through 281 with the aid of the INVERTOR-gates 270 through 273. The decoding is such a "1" binary logic state will be generated by the AND-gate 274 when the binary number output of the adder-211 is 3; a "1" binary logic state will be generated by the AND-gate 275 when the binary number output of the adder 211 is 4. The other decoding operates in a similar fashion and the AND-gate 281 will create a binary "1" logic output state when the binary number output of the adder 211 is 28.

The binary logic output states of the set of AND-gates 274 through 281 are used by the set of AND-gates 282–289 to select the indicated output data ports from the harmonic shift register 204. While the output data lines from the harmonic shift register are shown as single lines, this is to be understood as a drawing convenience to represent a plurality of data lines whose number corresponds to the number of binary bits in the binary representation of a harmonic coefficient. Similarly the single output line for the set of AND-gates 282 through 289 each represents a plurality of lines. The output data from the set of AND-gates 282 through 289 are furnished to the switch S4 by the OR-gate 290.

The other data selects 250, 208, 216, and 220 are implemented in a manner analogous to that shown in FIG. 3 for the select gate 212.

Figure 4:
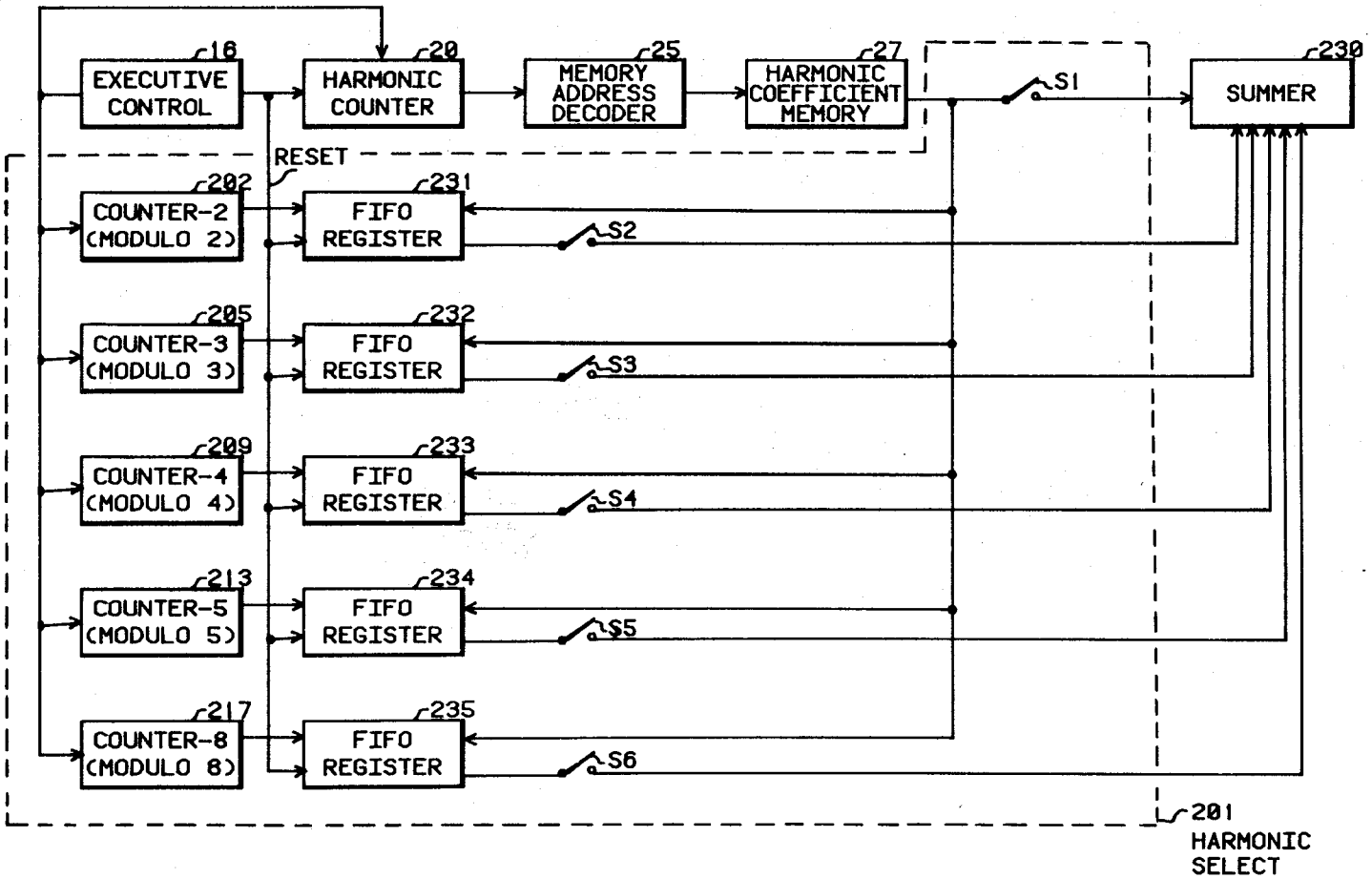
FIG. 4 is a schematic diagram of an alternate embodiment of the invention.

FIG. 4 illustrates an alternate embodiment of the present invention which employs FIFO (first-in first-out) registers in the implementation of the harmonic select 210. The memory address decoder 25 reads out harmonic coefficients from the harmonic coefficient memory 27 in response to the count state of the harmonic counter 20. The accessed harmonic coefficients from the harmonic coefficient memory 27 are stored in the set of FIFO registers 231 through 235. Each FIFO register is cleared at the start of a computation cycle in response to a RESET signal provided by the executive control 16.

As each of the counters 202, 205, 209, 213, 217 is incremented to return to its initial count state, a reset signal is generated. In response to a reset signal generated by one of these counters, a harmonic coefficient value is read out of the associated FIFO register.

The action of a counter and its associated FIFO register provides the desired timing and selection of harmonic coefficients. For example, consider the combination of the counter-4 209 and the FIFO register 233. When the harmonic counter 20 is at its initial count state, the first harmonic coefficient is addressed out of the harmonic coefficient memory and is stored in the FIFO register 233. When the harmonic counter 20 reaches a count state corresponding to the decimal number 4, the FIFO register 233 will contain the first four harmonic coefficients that have been read out from the harmonic coefficient memory 27. At this time, the counter-4 209 returns to its minimal count state and generates a reset signal. In response to this reset signal, the first harmonic coefficient is read out from the FIFO register 233 and furnished to the input terminals of the switch S4. When the harmonic counter 20 reaches a count state corresponding to the decimal number 8, the FIFO register 233 will contain the harmonic coefficients corresponding to the harmonic number sequence 2, . . . ,8. At this time, the counter-4 209 again returns to its minimal count state and generates a reset signal. In response to this reset signal, the second harmonic coefficient is read out from the FIFO register 233 and furnished to the input terminals of the switch S4.

The above operation is repeated until the harmonic counter 20 reaches its full decimal count of 32 at which time the computation cycle has been completed.

The present invention can also be incorporated into other tone generators of the type which synthesize musical waveshapes by implementing a Fourier-type transformation employing a selected set of harmonic coefficients. A system of this category is described in U.S. Pat. No. 3,809,786 entitled "Computer Organ." This patent is hereby incorporated by reference.

Figure 5:
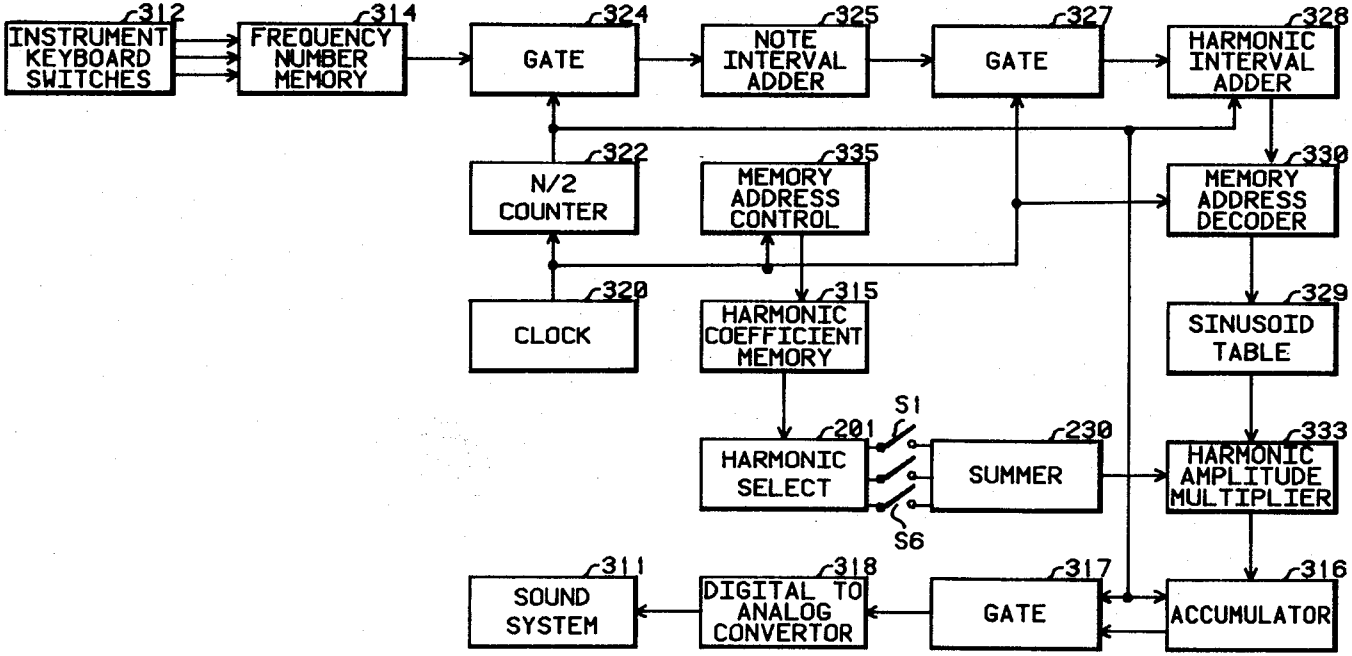
FIG. 5 is another alternative embodiment of the invention.

FIG. 5 illustrates a tone generation system which incorporates the present invention into the Computer Organ described in the referenced patent. The system blocks shown in FIG. 5 are numbered to be 300 plus the corresponding block numbers shown in FIG. 1 of the referenced patent.

A closure of a keyswitch contained in the instrument keyboard switches causes a corresponding frequency number to be accessed out from the frequency number memory 314. The accessed frequency number is added repetitively to the contents of the note interval adder 325. The content of the note interval adder 325 specifies the sample point at which a waveshape amplitude is calculated. For each sample point, the amplitudes of a number of harmonic components are calculated individually by multiplying harmonic coefficient values furnished by the summer 230 with trigonometric sinusoid values read out from the sinusoid table 321. The multiplication is accomplished by means of the harmonic amplitude multiplier 333. The harmonic component amplitudes are summed algebraically in the accumulator 316 to obtain the net amplitude at a waveshape sample point. The sample point amplitudes are converted into an analog signal by means of the digital-to-analog converter 318. The resultant analog signal is then furnished to the sound system 311.

The sinusoid table 329 stores values of the trigonometric function sin ($2\pi n/64$). These function values correspond to a waveshape having 64 points per period for the highest fundamental frequency musical pitch generated by the system.

The harmonic coefficients read out of the harmonic coefficient memory 315 in response to the memory address control 335 are processed by the harmonic select 201 in the manner previously described for the tone generation system shown in FIG. 1.

A polyphonic tone generator for the Computer Organ is implemented by time sharing the functions previously described in a sequence of time slots. Each time slot corresponds to a detected actuated keyswitch and thus corresponds to an individual tone generator. The accumulator 316 sums the computation of points for one sequence of time slots and the combined data point is furnished to the digital-to-analog convertor 318.

I claim:

1. In combination with a musical instrument in which a plurality of data words corresponding to the amplitudes of points defining the waveform of a musical tone are computed from a preselected set of harmonic coefficients, corresponding in number to the maximum number of harmonics in said musical tone, during each one of a sequence of computation cycles and are transferred sequentially to a means for conversion into musical waveshapes, apparatus for selectively combining said set of harmonic coefficients to produce the tonal effect of intramanual coupling comprising;

a harmonic coefficient memory means for storing said preselected set of harmonic coefficients corresponding in number to the maximum number of harmonics in said musical tone, a first addressing means for sequentially reading out said set of harmonic coefficients from said harmonic coefficient memory means to form a basic sequence of harmonic coefficients, a plurality of harmonic coefficient select means each of which selects a subset of said basic sequence of harmonic coefficients to form a corresponding subset sequence of harmonic coefficients, a harmonic combining means whereby selected ones of said subset sequences of harmonic coefficients are combined to form a combination harmonic coefficient sequence, a waveshape memory means, a means for computing responsive to said combination harmonic coefficient sequence whereby said plurality of data words corresponding to said amplitudes of points defining the waveform of a musical tone are computed and stored in said waveshape memory means during each said computation cycle, a second addressing means for sequentially and repetitively reading out data words stored in said waveshape memory means, and a means for producing a musical tone from data words read out from said waveshape memory means.

2. In a musical instrument according to claim 1 wherein said means for computing comprises;

a logic clock means for providing logic timing signals, and a harmonic counter responsive to said logic timing signals.

3. In a musical instrument according to claim 2 wherein said first addressing means comprises a memory decoding means responsive to the count state of said harmonic counter whereby a harmonic coefficient corresponding to said count state is accessed from said harmonic coefficient memory means.

4. In a musical instrument according to claim 1 wherein said harmonic combining means comprises;

a plurality of coupler switches each of which corresponds to one of said plurality of harmonic coefficient select means and wherein one of said harmonic coefficient sequences is provided as an input to an associated corresponding coupler switch, and a summer means connected to the output of each one of said plurality of coupler switches for combining said harmonic coefficient sequences corresponding to said plurality of coupler switches which are in their actuated switch state thereby forming said combination harmonic coefficient sequence.

5. In a musical instrument according to claim 2 wherein said means for computing further comprises;

a master clock for providing timing signals, a word counter for counting said timing signals modulo the number of said plurality of data words stored in said waveshape memory means and whereby one of said logic timing signals is generated each time said word counter returns to its minimal count state, an adder-accumulator means wherein the count state of said harmonic counter is successively added to the content of an accumulator in response to said timing signals and wherein the content of said accumulator is initialized to a zero value at the start of said computation cycle, a sinusoid table storing a set of trigonometric function values, a sinusoid table addressing means responsive to the content of said adder-accumulator means for reading out a trigonometric function value from said sinusoid table, a multiplying means for multiplying said read out trigonometric value by one of said harmonic coefficients contained in said combination harmonic coefficient sequence to form an output product data value, and a means for successively summing said output data value with data words read out from said waveshape memory means and whereby the summed value is stored in said waveshape memory means.

6. In combination with a musical instrument in which a plurality of data words corresponding to the amplitudes of points defining the waveform of a musical tone are computed from a preselected set of harmonic coefficients during each one of a sequence of computation cycles and are transferred sequentially to a means for conversion into musical waveshapes, apparatus for selectively combining said set of harmonic coefficients to produce the tonal effect of intramanual coupling comprising:

a harmonic coefficient memory means for storing said preselected set of harmonic coefficients, a first addressing means for sequentially reading out said set of harmonic coefficients from said harmonic coefficient memory means to form a basic sequence of harmonic coefficients, a logic clock means for providing logic timing signals, a plurality of counter means wherein each counter means counts said logic timing signals modulo a preselected counting number which is associated with a corresponding counter means, a plurality of adder means each of which is associated with a corresponding one of said plurality of counter means whereby a preselected offset number which is associated with a corresponding adder means is added to the count state of said corresponding one of said plurality of counter means to form a corresponding data select number, a plurality of data select means each of which is associated with a corresponding one of said plurality of adder means whereby each one of said plurality of data select means selects one harmonic coefficient from said basic sequence of harmonic coefficients in response to said corresponding data select number to form a corresponding one of a subset sequence of harmonic coefficients, a plurality of harmonic coefficient select means each of which selects a subset of said basic sequence of harmonic coefficients to form a corresponding subsequence of harmonic coefficients, a harmonic combining means whereby selected ones of said subsequences of harmonic coefficients are combined to form a combination harmonic coefficient sequence, a waveshape memory means, a means for computing responsive to said combination harmonic coefficient sequence whereby said plurality of data words corresponding to said amplitudes of points defining the waveform of a musical tone are computed and stored in said waveshape memory means during said computation cycle, a second addressing means for sequentially and repetitively reading out data words stored in said waveshape memory means, and a means for producing a musical tone from data words read out from said waveshape memory means.

7. In combination with a musical instrument in which a plurality of data words corresponding to the amplitude of points defining the waveform of a musical tone are computed from a preselected set of harmonic coefficients during each one of a sequence of computation cycles and are transferred sequentially to a means for conversion into musical waveshapes, apparatus for selectively combining said set of harmonic coefficients to produce the tonal effect of intramanual coupling comprising:

a harmonic coefficient memory means for storing said preselected set of harmonic coefficients, a first addressing means for sequentially reading out said set of harmonic coefficients from said harmonic coefficient memory means to form a basic sequence of harmonic coefficients, a logic clock means for providing logic timing signals, a plurality of counter means wherein each counter means counts said logic timing signals modulo a preselected counting number which is associated with a corresponding counter means, a plurality of first-in first-out storage means, a storage addressing means whereby said basic sequence of harmonic coefficients read out from said harmonic coefficient memory means is stored in each one of said plurality of first-in first-out storage means, a storage read out means whereby a harmonic coefficient stored in one of said first-in first-out storage means is read out when the count state of its associated counter means is incremented to its minimal count state thereby forming a corresponding one of a subset sequence of harmonic coefficients, a harmonic combining means whereby selected ones of said subset sequences of harmonic coefficients are combined to form a combination harmonic coefficient sequence, a waveshape memory means, a means for computing responsive to said combination harmonic coefficient sequence whereby said plurality of data words corresponding to said amplitudes of points defining the waveform of a musical tone are computed and stored in said waveshape memory means during each one of said sequence of computation cycles, a second addressing means for sequentially and repetitively reading out data words stored in said waveshape memory means, and a means for producing a musical tone from data words read out from said waveshape memory means.

8. In a musical instrument according to claim 7 wherein said harmonic combining means comprises;

a plurality of coupler switches each of which corresponds to one of said plurality of first-in first-out storage means and wherein the harmonic coefficient read out from an associated first-in first-out storage means is provided to an input of an associated corresponding coupler switch, and a summer means connected to the output of each one of said plurality of coupler switches for combining the harmonic coefficients transferred by said plurality of coupler switches which are in their actuated switch state thereby forming said combination harmonic coefficient sequence.

9. In combination with a musical instrument in which a plurality of data words are computed at regular time intervals from a preselected set of harmonic coefficients, corresponding in number to the maximum number of harmonics in a generated musical tone, and wherein said data words are converted into musical waveshapes, apparatus for selectively combining said set of harmonic coefficients to produce the tonal effect of intramanual coupling comprising;

a harmonic coefficient memory means for storing said preselected set of harmonic coefficients, a first addressing means for reading out said set of harmonic coefficients from said harmonic coefficient memory means to form a basic sequence of harmonic coefficients, a plurality of harmonic coefficient select means each of which selects a subset of said basic sequence of harmonic coefficients to form a corresponding subset sequence of harmonic coefficients, a harmonic combining means whereby selected ones of said subset sequences are combined to form a combination harmonic coefficient sequence, a means for computing, responsive to said combination harmonic coefficient sequence, for computing a sequence of data words at regular time intervals, and a means for producing musical waveshapes from said sequence of data words.

10. In a musical instrument according to claim 9 wherein said means for computing comprises;

a means for obtaining a frequency number, a note interval adder wherein said frequency number is successively added to the sum previously contained in said interval adder, a harmonic interval adder cleared before each computation of one of said sequence of data words wherein the content of said note interval adder is added to the content previously contained in said harmonic interval adder, a sinusoid table for storing a plurality of trigonometric sinusoid values, an address decoder means responsive to the contents of said harmonic interval adder for reading out trigonometric sinusoid values from said sinusoid table, and a multiplier means for multiplying the trigonometric sinusoid values read out from said sinusoid table by said combination harmonic coefficient sequence thereby creating said sequence of data words each of which corresponds to a combination of tone generators.

11. In combination with a musical instrument in which a musical tone is synthesized by evaluating the constituent Fourier components of a musical waveshape from a preselected set of harmonic coefficients, apparatus for selectively combining said set of harmonic coefficients to produce the tonal effect of intramanual coupling comprising;

a harmonic coefficient memory for storing said preselected set of harmonic coefficients wherein said set is equal in number to the number of said constituent Fourier components, a plurality of harmonic coefficient select means each of which selects a subset of said set of harmonic coefficients, a harmonic combining means whereby said subsets of said set of harmonic coefficients are combined to form a combination set of harmonic coefficients, a means for computing responsive to said combination set of harmonic coefficients for evaluating said constituent Fourier components, and means for producing musical waveshapes from said constituent Fourier components.

* * * * *